US009060654B2

(12) United States Patent
Wegelin et al.

(10) Patent No.: US 9,060,654 B2
(45) Date of Patent: Jun. 23, 2015

(54) DISPENSER WITH MULTI-DIRECTIONAL PUSHBAR

(75) Inventors: Jackson W. Wegelin, Stow, OH (US); Matthew J. Archer, Aurora, OH (US); Paul Brown, Parma, OH (US)

(73) Assignee: GOJO Industries, Inc., Akron, OH (US)

( * ) Notice: Subject to any disclaimer, the term of this patent is extended or adjusted under 35 U.S.C. 154(b) by 102 days.

(21) Appl. No.: 13/209,934

(22) Filed: Aug. 15, 2011

(65) Prior Publication Data

US 2013/0043284 A1 Feb. 21, 2013

(51) Int. Cl.

| | |
|---|---|
| ***B65D 83/00*** | (2006.01) |
| ***B67D 7/06*** | (2010.01) |
| ***B65D 47/00*** | (2006.01) |
| ***B65D 3/00*** | (2006.01) |
| ***A47K 5/12*** | (2006.01) |

(52) U.S. Cl.

CPC ..... *A47K 5/1211* (2013.01); *A47K 5/12* (2013.01)

(58) Field of Classification Search

CPC ..... A47K 5/12; A47K 5/1211; B65D 83/206; B65D 83/46

USPC ..... 222/402.1–402.25, 180–181.3, 407, 222/517, 105, 185.1, 635, 556, 559

See application file for complete search history.

(56) References Cited

U.S. PATENT DOCUMENTS

| | | | | |
|---|---|---|---|---|
| 2,831,613 | A * | 4/1958 | Soffer | 222/182 |
| 2,831,620 | A * | 4/1958 | Schlicksupp | 222/517 |
| 3,343,729 | A * | 9/1967 | Rait | 222/402.21 |
| 3,889,856 | A * | 6/1975 | Morane | 222/402.13 |
| 3,946,911 | A * | 3/1976 | Morane et al. | 222/402.11 |
| 5,335,832 | A * | 8/1994 | de Laforcade | 222/402.13 |
| 6,237,812 | B1 * | 5/2001 | Fukada | 222/181.2 |
| 6,439,440 | B1 * | 8/2002 | Lasserre | 222/402.21 |
| 6,484,895 | B2 * | 11/2002 | Montgomery et al. | 215/237 |
| 6,491,187 | B2 * | 12/2002 | Walters | 222/185.1 |
| 6,827,239 | B2 * | 12/2004 | Lasserre et al. | 222/153.11 |
| 7,032,782 | B1 * | 4/2006 | Ciavarella et al. | 222/181.3 |
| 7,077,299 | B2 | 7/2006 | Amidzich | |
| 7,175,053 | B2 | 2/2007 | Simon et al. | |
| 7,367,477 | B2 * | 5/2008 | Ophardt et al. | 222/181.3 |
| 7,708,173 | B2 * | 5/2010 | Bromber | 222/463 |
| 2008/0230566 | A1 * | 9/2008 | Frutin | 222/402.15 |

* cited by examiner

*Primary Examiner* — Frederick C Nicolas

*Assistant Examiner* — Matthew Lembo

(74) *Attorney, Agent, or Firm* — Renner Kenner Greive Bobak Taylor & Weber

(57) ABSTRACT

A product dispenser includes a housing adapted to receive a refill unit having a product reservoir. A multidirectional pushbar is carried by the housing and movable in a plurality of directions to actuate the pump. The multidirectional pushbar may be carried by a collar pivotally secured around a pushbar support member in the shape of a spherical zone. Pivoting movement of the multidirectional pushbar is converted into an actuating force by a transfer mechanism, which may include a vertically movable carriage. In other embodiments, the multidirectional pushbar may include ramped surfaces and may support a carriage having rolling elements. Lateral movement of the multidirectional pushbar causes the carriage to roll up the ramped surfaces and actuate a pump to dispense a product.

21 Claims, 11 Drawing Sheets

DISPENSER WITH MULTI-DIRECTIONAL PUSHBAR

FIELD OF THE INVENTION

The present invention relates generally to wall mounted product dispensers. More specifically, the present invention relates to wall mounted product dispensers of a fluid or foam that include a multi-directional pushbar to allow actuation of the dispenser from a plurality of angles and positions around the dispenser.

BACKGROUND OF THE INVENTION

It is well known to provide fluid dispensers for use in restaurants, factories, hospitals, bathrooms and the home. These dispensers may contain one of a number of products such as, for example, soap, anti-bacterial cleansers, disinfectants, and lotions. Dispensers often include some type of manual pump actuation mechanism where the user pushes or pulls a lever to dispense a quantity of fluid, as is known in the art. Alternatively, "hands-free" automatic dispensers may also be utilized where the user simply places one or both hands underneath a sensor and a quantity of fluid is dispensed. Similar types of dispensers may be used to dispense powder or aerosol materials.

Product dispensers are commonly configured to be mounted to a wall or other vertical surface, with the product being dispensed from an outlet near the bottom of the dispenser. It is also known that dispensers may be integrated into a countertop near a sink basin, with certain components of the dispensing system being located beneath the countertop, and other components, including an outlet, being located above the countertop. These types of dispensers are often referred to as counter-mount dispensing systems. Various other configurations of dispensers are also known, including table-top style dispensers that rest on a horizontal surface such as a counter or table top, or stand mounted dispensing systems that attach to a mounting pole.

In the case of manually actuated wall mounted dispensers, known actuation mechanisms include pushbars that reciprocate and are biased to an unactuated position. Movement of the pushbar causes actuation of the pump, which results in the dispensing of a product from the dispenser. Notably, actuation of the pump of such conventional dispensers requires pressing a movable pushbar that is only capable of movement in a single dimension. Accordingly, actuation of the pump requires that a force is applied to the pushbar at the correct angle to cause the pushbar to move, thereby actuating the pump and causing discharge of a product from the dispenser.

In many situations, it may be difficult or uncomfortable for a user to apply the required force at the necessary angle to actuate the dispenser. For example, where a wall mounted dispenser is positioned over a semi-circular sink, such as in healthcare environments, users may stand in any number of locations surrounding the dispenser while using the sink. Users not directly in front of the dispenser may find it difficult or impossible to press the pushbar at the required angle and with the necessary force to cause a product to be dispensed without moving to stand closer to the dispenser. When multiple users are positioned around such a sink then they are forced to work around one another. Similar difficulties may arise in environments where a dispenser is mounted to a vertical surface between two adjacent sinks, such as in many public restrooms. Again, the user may find it difficult to actuate conventional manually actuated dispensers without first moving to stand closer to the dispenser.

Furthermore, repeated actuation of conventional dispensers with known pushbars by users who are not positioned directly in front of the dispenser causes increased wear, and may cause failure, of the actuation mechanism over time. Each time such a pushbar is pressed at an angle, a portion of the force applied is directed to the hinge mechanism of the pushbar, or other components of the actuation system, rather than into the pump actuation mechanism to cause dispensing of a product. This repeated and continuous stress may result in failure of the actuation mechanisms, or in less than optimum performance. In addition, in cases where the input force applied by a user is not efficiently transferred to the pump mechanism of the dispenser, a greater input force will be required, making use of the dispenser more difficult.

Thus, there is a need for an improved manual actuation device for a dispenser that alleviates one or more of the deficiencies of the prior art, as discussed above.

SUMMARY OF THE INVENTION

In light of the foregoing, it is a first aspect of the present invention to provide a wall mounted dispenser that is easy to actuate from any position surrounding the dispenser.

It is another aspect of the present invention to provide a dispenser, as above, that efficiently transfers user applied force to the pump mechanism to cause dispensing of a product.

It is still another aspect of the present invention to provide a pushbar that may be pressed from a plurality of directions to cause actuation of a dispenser.

It is yet another aspect of the present invention to provide a pushbar, as above, that allows for actuation of a wall mounted dispenser from any location surrounding the dispenser.

In general, a product dispenser according to the present invention includes a housing adapted to retain a product refill unit having a product reservoir; a multidirectional pushbar adapted to be movable in a plurality of directions to actuate the dispenser; and a transfer mechanism adapted to cause dispensing of a product upon movement of the multidirectional pushbar by converting the input force applied to the pushbar into an actuating force.

In accordance with at least one aspect of the present invention, a product dispenser includes a housing including a backplate and a cover and adapted to receive a refill unit having a product reservoir; a pushbar support member carried by the backplate of the housing, the pushbar support member having the shape of a spherical zone; a multidirectional pushbar pivotable about the pushbar support member in a plurality of directions; and a transfer mechanism adapted to cause dispensing of a product upon movement of the multidirectional pushbar by converting the input force applied to the pushbar into an actuating force.

In accordance with at least one aspect of the present invention, a product dispenser includes a housing having a backplate and a cover and adapted to receive a refill unit including a product reservoir and a piston pump, the piston pump adapted to dispense product from the product reservoir when actuated; a multidirectional pushbar laterally movable in a plurality of directions relative to the housing and including a valley between opposed ramped surfaces; and a carriage including a retainer member adapted to receive an end of a piston extending from the piston pump and a plurality of arms extending radially outwardly from the retainer, each arm including a rolling element on a distal end, where lateral movement of the pushbar causes the carriage to roll up the ramps and cause axial movement of the piston to dispense a product.

BRIEF DESCRIPTION OF THE DRAWINGS

For a full understanding of the invention reference should be made to the following detailed description and the accompanying drawings, wherein.

DETAILED DESCRIPTION OF THE ILLUSTRATIVE EMBODIMENTS

The present invention relates generally to product dispensers actuated by a multidirectional pushbar. The product dispensers may be adapted to dispense an aerosol product, liquid products, foam products, or any other known type of product dispensed from a dispenser having a pushbar actuation mechanism. The multidirectional pushbar allows for an actuation force to be applied by a user in a plurality of directions and from a number of positions. The dispenser is thereby rendered easier to use, and stresses placed on the components of the actuation mechanism are reduced. In certain embodiments, the multidirectional pushbar may be mounted by a "ball and socket" type hinge that allows for pivoting movement in a plurality of directions. In other embodiments, the pushbar may be laterally movable in a plurality of directions to actuate the pump. A transfer mechanism is provided to convert input force applied to the pushbar to a pump or nozzle to cause dispensing of the product.

Figure 1:
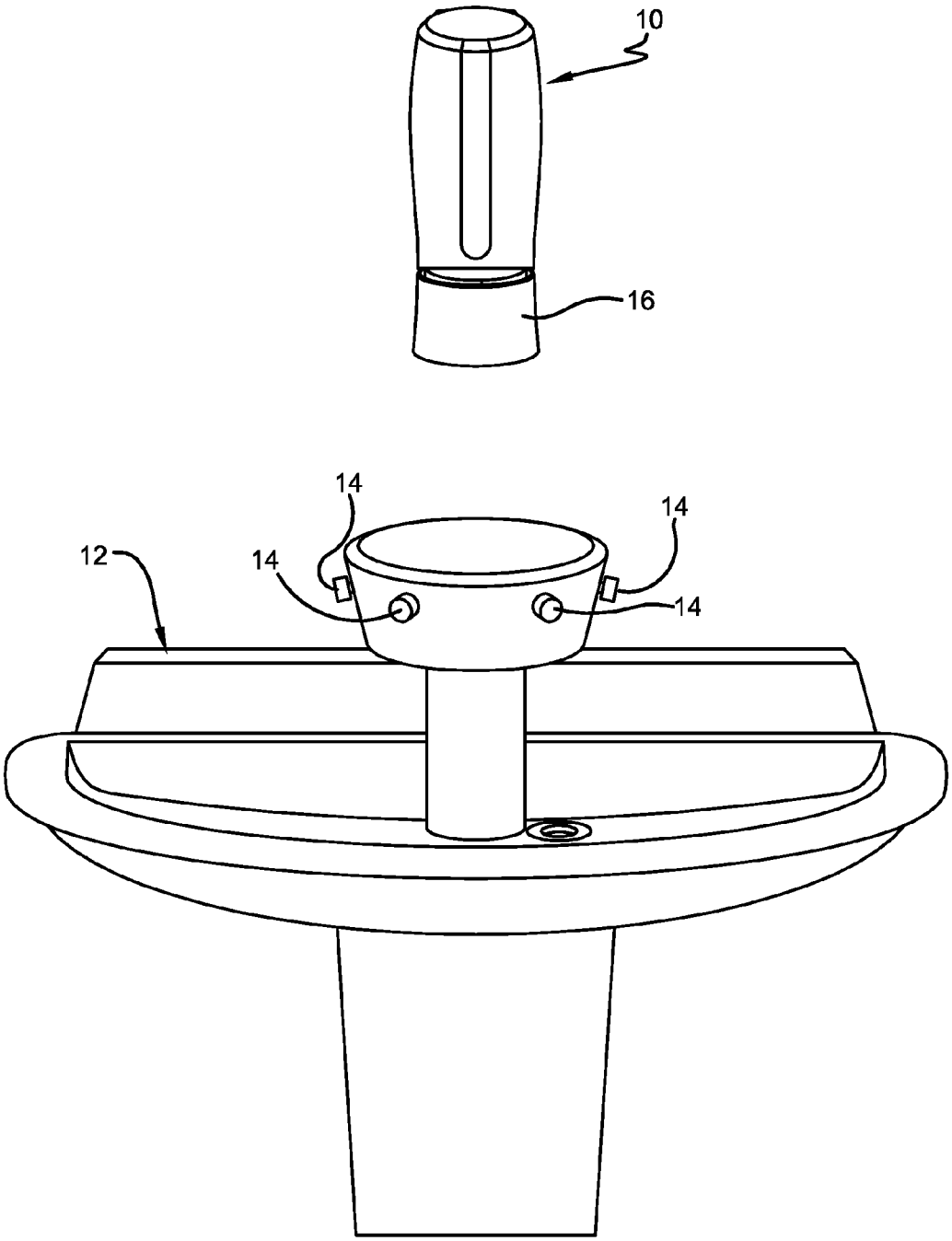
FIG. 1 is a front elevational view of a dispenser mounted over a sink according to the concepts of the present invention.
Figure 2:
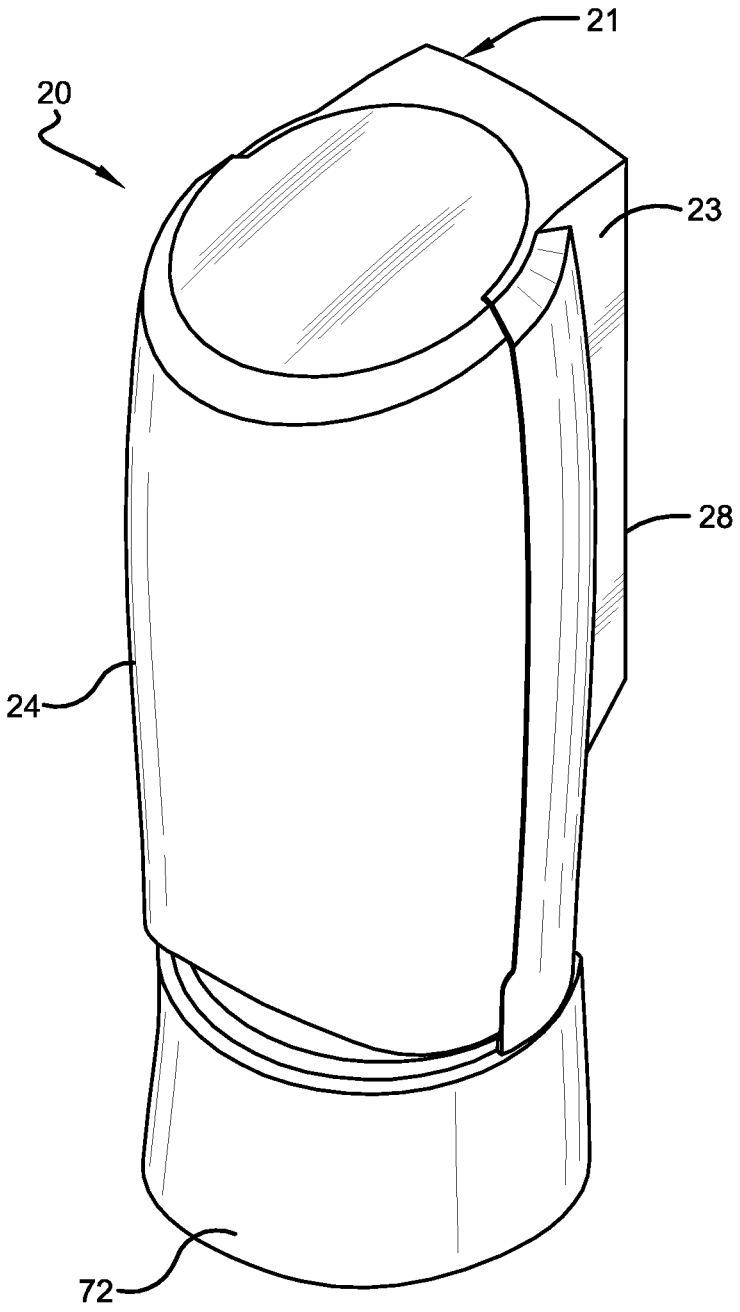
FIG. 2 is a perspective view of a dispenser according to the concepts of the present invention.

Referring now to FIG. 1, a dispenser made according to the concepts of the present invention is shown, and is generally indicated by the numeral 10. Dispenser 10 is a wall mounted dispenser, and is secured to a wall over a sink 12. Sink 12 is generally semi-circular in shape, and includes a plurality of faucets 14 facing in various directions. As will be appreciated by those skilled in the art, sink 12 is designed to allow several people to wash their hands simultaneously. This may be desirable or necessary in various environments, including in hospitals, food processing factories, or any other area where cleanliness is especially important. As will be described in detail in the description to follow, dispenser 10 includes a multi-directional pushbar 16 that allows users at any location around sink 12 to conveniently push the pushbar in a direction away from their position to actuate the dispenser. While FIG. 1 discloses one particular environment in which a dispenser 10 having a multi-directional pushbar 16 may be useful, it is also contemplated that a dispenser having a multi-directional pushbar may be positioned in any desired location where actuation of the dispenser from multiple angles or positions may be necessary or useful.

FIGS. 2-5 depict a first embodiment of a dispenser having a multi-directional pushbar, which is referred to generally by the numeral 20. The dispenser 20 is an aerosol type dispenser, and is adapted to dispense aerosol products. Dispenser 20 includes a housing 21 and a refill unit 22. Housing 21 comprises a backplate 23 and a cover 24 pivotally secured to backplate 23. In other embodiments, cover 24 may be removably secured to backplate 23 requiring that the cover be completely removed from backplate 23 to replace the refill unit 22 in the dispenser 20. Backplate 23 and cover 24 may be provided in any variety of shapes and configurations as desired or as necessitated by other design considerations. In the embodiment depicted in FIGS. 2-5, backplate 23 and cover 24, together, form a housing 21 that is generally cylindrical in shape. Backplate 23 may include one or more holes or openings 26 (FIG. 5) in a generally planar back wall 28 to facilitate attachment of dispenser 20 to a wall or other surface. Backplate 23 also includes a cut-out 29 adjacent a bottom portion of housing 21 where the side portions of the backplate 23 extend lower than the back portion of the backplate. Cut-out 29 prevents the backplate 23 from impeding movement of the pushbar, as will become apparent from the description to follow.

An actuator pushbar support member 30 extends downwardly and outwardly from backplate 23. The pushbar support member 30 is adapted to support the components of the actuating mechanism and to receive and support a refill unit 22 therein. Pushbar support member 30 includes a radiused body portion 32 that has an outer surface 34 and an inner surface 36. The radiused body portion is in the form of a spherical layer—a portion of a sphere defined by two parallel planes. A top edge 38 of body portion 32, which is the top base of the spherical zone, is generally circular in shape, and is oriented in a plane generally perpendicular to planar back wall 28. Body portion 32 may also include a downwardly extending neck 40 extending from a bottom edge of body portion 32, which is the bottom base of the spherical zone. The neck 40 accommodates a neck portion 42 of the refill unit 22. Neck 40 is generally cylindrical, and has a diameter that is less than the diameter of top edge 38. Neck 40 includes a center axis 41 that is oriented vertically and passes through a center point of body portion 32.

Figure 5:
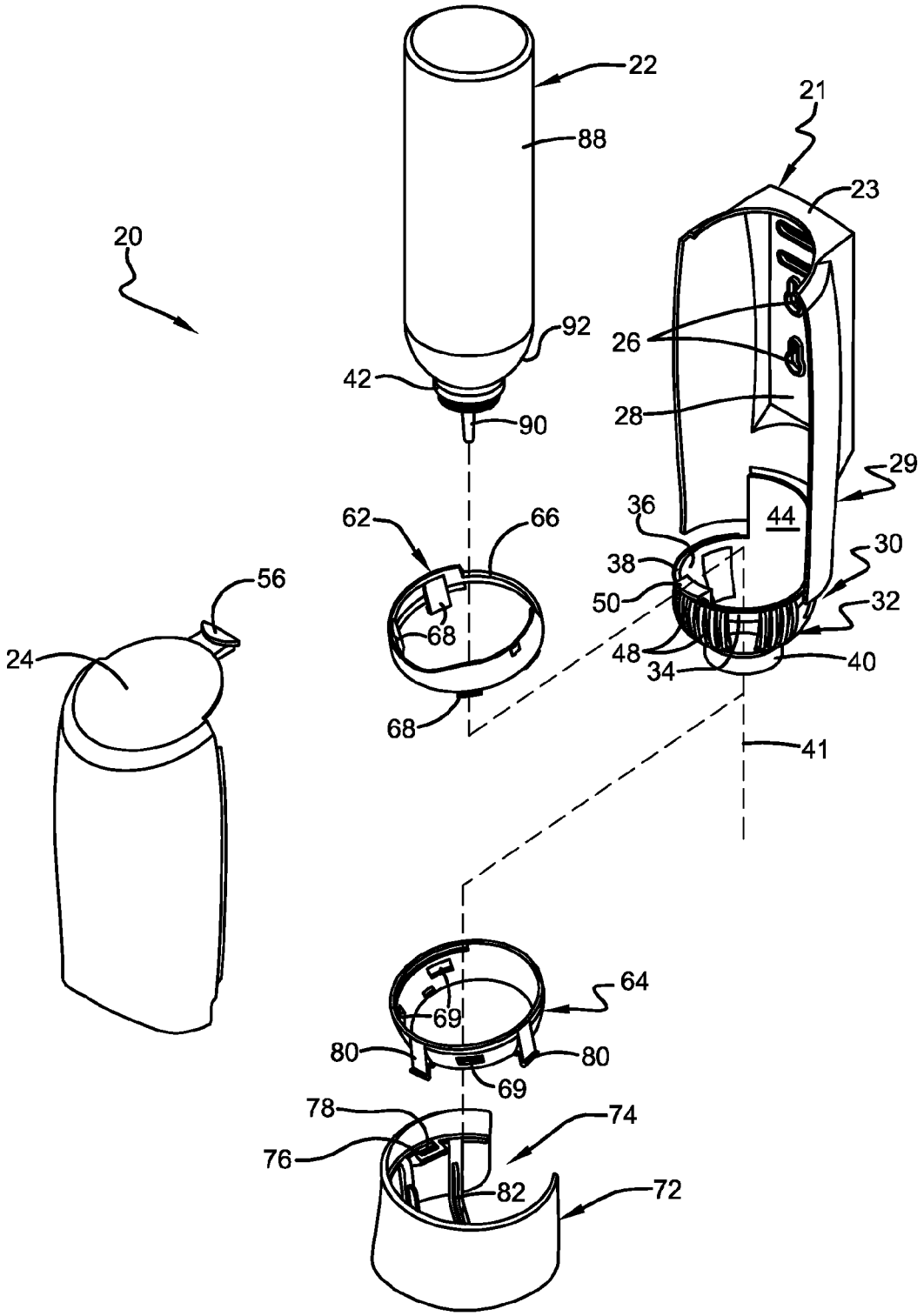
FIG. 5 is a perspective exploded view of the dispenser of FIG. 2.
Figure 5A:
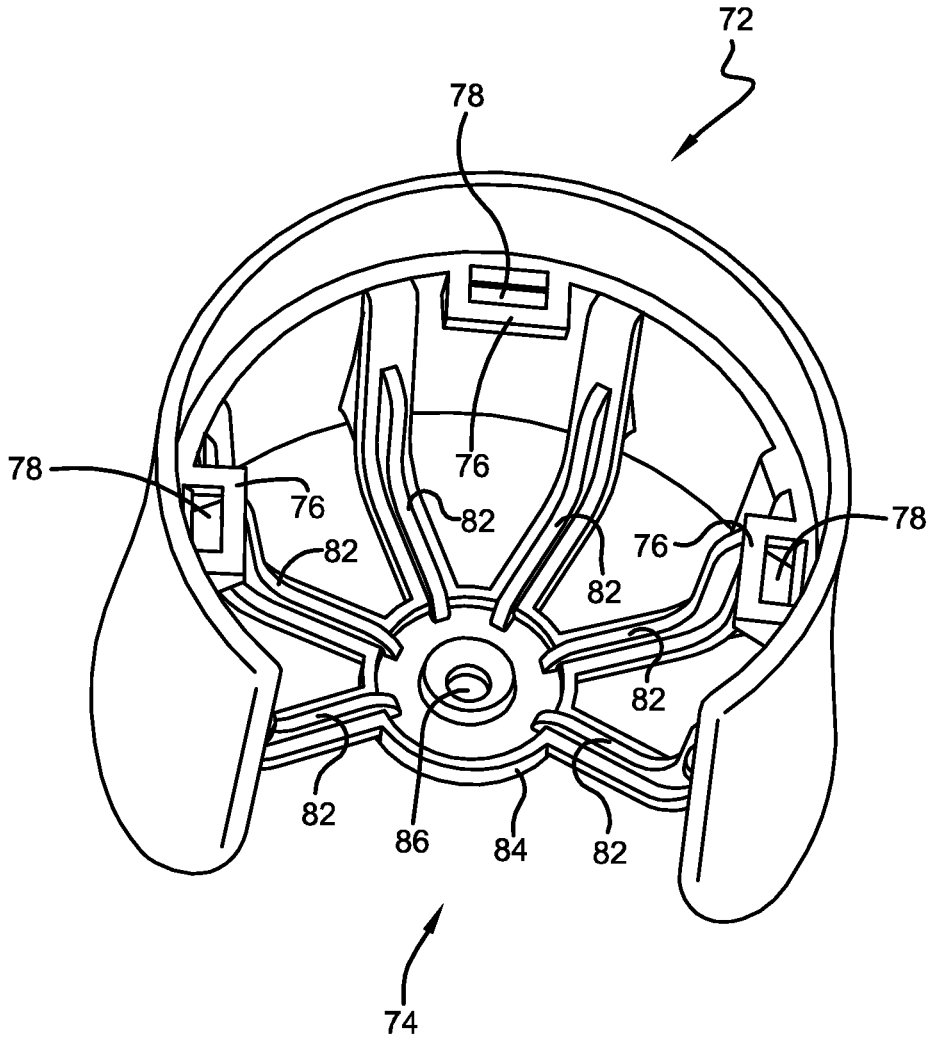
FIG. 5A is a top perspective view of the pushbar of FIGS. 1-5 showing the retainer that receives a flexible tip of a refill unit.

Pushbar support member 30 also includes an arm 44 extending upwardly from top edge 38 of body portion 32, the arm being secured to backplate 23. In certain embodiments, arm 44 may be formed integrally with body portion 32. In one or more embodiments, arm 44, body portion 32, and backplate 23 may all be formed from a single integral piece of a molded polymeric material. Arm 44 is sized and shaped so as to leave a significant portion of body portion 32 suspended without contact with backplate 23. In certain embodiments, arm 44 may extend directly from a portion of top edge 38 of body portion 32, the portion accounting for less than twenty-five percent of the total circumference of top edge 38. Thus, in such an embodiment, and as shown in FIG. 5, at least seventy-five percent (270°) of the circumference of top edge 38 is exposed. It is also contemplated that pushbar support member 30 may be provided as two or more distinct components that are assembled and secured to backplate 23 for ease of manufacturing.

Body portion 32 of pushbar support member 30 may include a plurality of spaced radial fins 48 extending outwardly from outer surface 34. Fins 48 reduce friction on the sliding surfaces of the ball and socket joint, which is described in greater detail below. Pushbar support member 30 also includes a cover mounting arm 50 extending upwardly from body portion 32 opposite arm 44. Cover mounting arm 50 includes a plurality of clips 52 extending in a direction opposite backplate 23 that are adapted to receive a pivot pin 54 on cover 24. Pin 54 rotates within clips 52 to allow cover 24 to pivot relative to backplate 23. A latch member 56 is provided on cover 24 to secure the cover to the backplate 23 in a closed position.

A collar 60 is positioned around body portion 32 of pushbar support member 30. Collar 60 includes a top collar portion 62 and a bottom collar portion 64 that, when secured together, form collar 60. Collar 60 is generally cylindrical in shape, but has a radius, or curve, from top to bottom so that collar 60 mirrors the shape of body portion 32. Thus, as will be appreciated by those skilled in the art, body portion 32 and collar 60 form a "ball and socket joint" where collar 60 is the "socket" and body portion 32 acts as the "ball." The curve or radius of collar 60 also helps to retain the collar on the pushbar support member 30 while allowing the collar to pivot around body portion 32. As will be appreciated by those skilled in the art, collar 60 is sized to fit over and around body portion 32 with a small space or gap therebetween to facilitate movement of collar 60 relative to body portion 32.

Top collar 62 includes a recess 66 that aligns with arm 44 of pushbar support member 30. Recess 66, along with cut-out 29 of backplate 23, allows collar 60 to pivot in a front-to-back direction despite the presence of arm 44. Top collar 62 also includes a plurality of latch members 68 that extend downwardly from top collar 62. Latch members 68 are received in slots 69 in bottom collar 64 to secure top collar 62 to bottom collar 64. Latch members 68 and slots 69 may be provided in any desired configuration known to those skilled in the art and capable of securely attaching the top and bottom collars 62 and 64 together. The inclusion of top and bottom collars 62 and 64, as opposed to providing a one-piece collar, facilitates assembly of the actuation mechanism. The seam between top collar 62 and bottom collar 64 is positioned on a plane of orientation that, in an unactuated state, is generally horizontal.

A pushbar 72 is secured to collar 60 and acts as an input mechanism for a user to actuate dispenser 20. Pushbar 72 is generally cylindrical in shape with an opening 74 that, when assembled, is located at the rear of the dispenser below arm 44. Pushbar 72 includes a plurality of inwardly extending brackets 76 that include a slot or opening 78 therein. Bottom collar 64 includes a plurality of corresponding latch members 80 extending downwardly therefrom, the latch members 80 being received in the slots 78 in the brackets 76 to secure pushbar 72 to collar 60. In certain embodiments, three or more brackets 76 and corresponding latch members 80 are provided and are spaced about bottom collar 64 and the interior of pushbar 72. Thus, pushbar 72 is secured to collar 60 so that the pushbar may be pivoted about body portion 32 of pushbar support member 30 in a plurality of directions. Alternatively, it is contemplated that pushbar 72 could be integrally formed with bottom collar 64.

A plurality of arms 82 extend between an inner surface of the pushbar 72 and a retainer 84 positioned approximately on the center axis 41. In certain embodiments, retainer 84 may be positioned adjacent to a bottom edge of pushbar 72. Retainer 84 is generally disc shaped, and includes an aperture 86 therethrough. Any desired number of arms 82 may be provided to support retainer 84, or alternative mechanisms may be employed to support retainer 84. Because retainer 84 is carried by pushbar 72, pivoting of the pushbar causes a swinging movement of the retainer.

Refill unit 22 contains an aerosol product, and includes a product reservoir 88 and a flexible tip 90, as is known in the art. Product reservoir 88 is cylindrical in shape and includes a radiused shoulder 92 and the neck portion 42. Flexible tip 90 extends from neck portion 42 and, when bent, causes dispensing of the product contained within product reservoir 88. Refill unit 22 is received within housing 21, with shoulder 92 contacting and being supported by the inner surface 36 of body portion 32. Neck portion 42 is received in neck 40 of body portion 32, and flexible tip 90 extends downwardly from neck portion 42 to be received in retainer 84. In an unactuated state, flexible tip 90 is positioned substantially on center axis 41.

Figure 3:
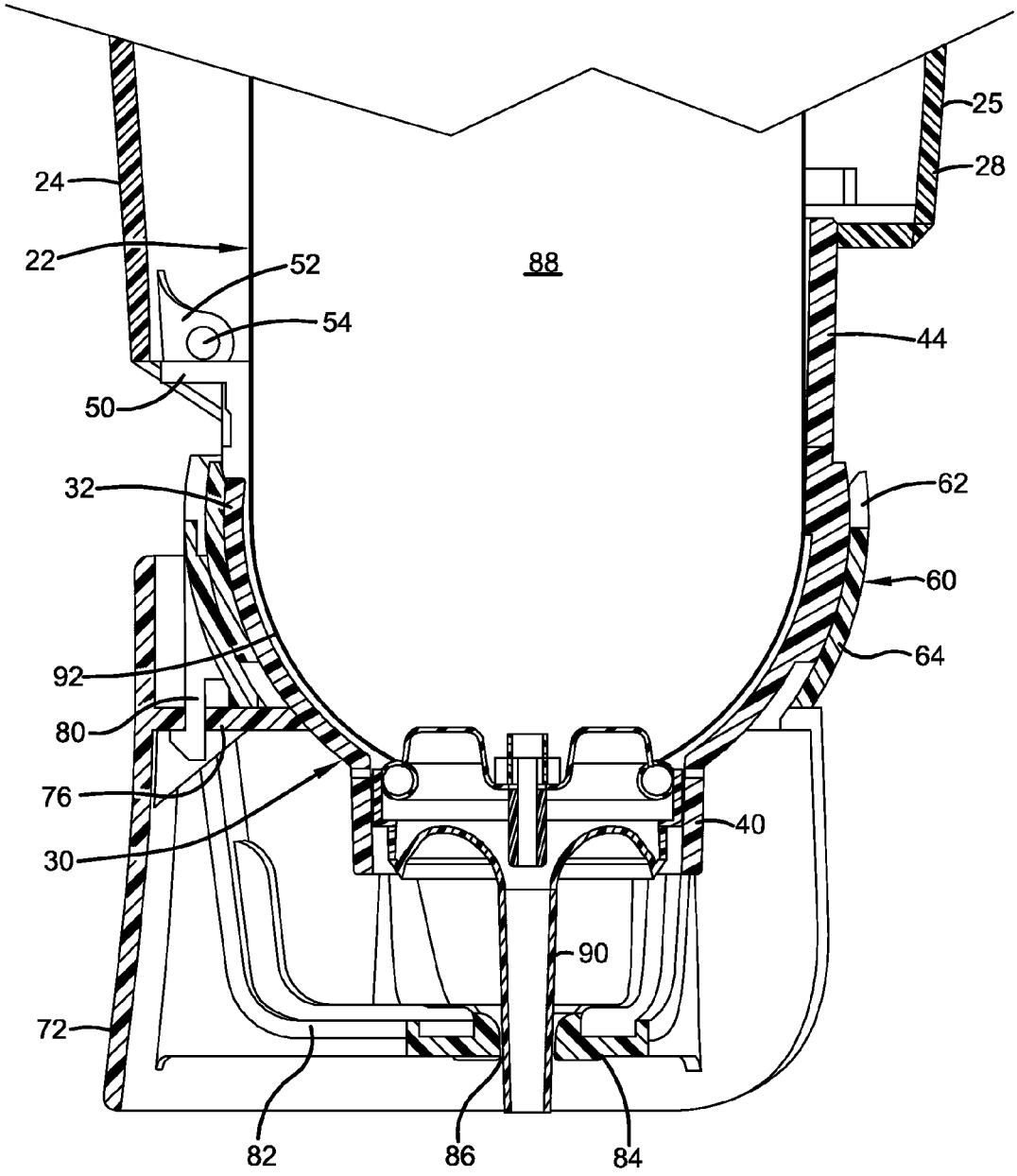
FIG. 3 is a fragmentary sectional view of the dispenser of FIG. 2 where the pushbar is in an unactuated position.
Figure 4:
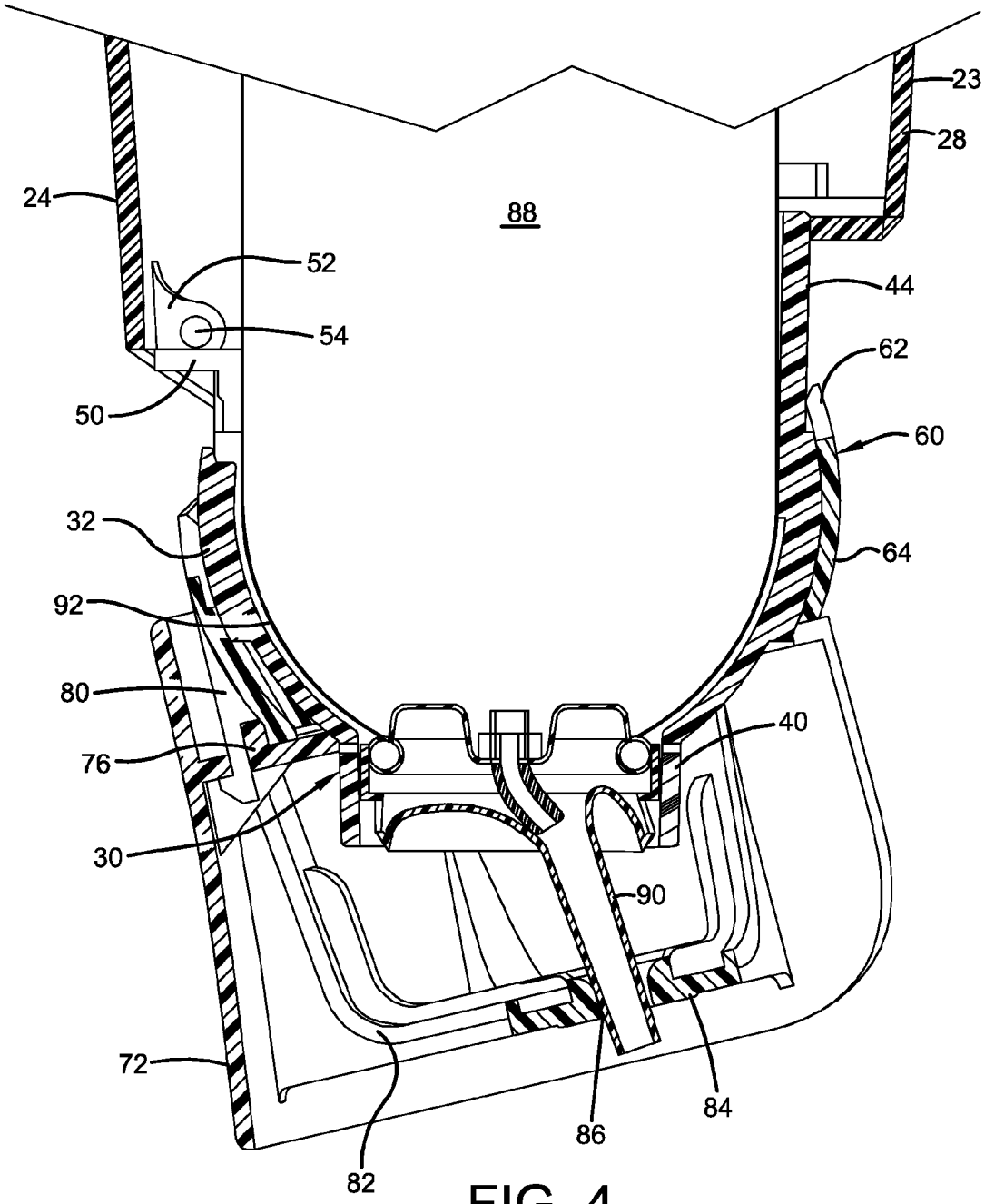
FIG. 4 is a fragmentary sectional view of the dispenser of FIG. 2 where the pushbar is in an actuated position.

Referring to FIGS. 3 and 4, actuation of the dispenser 20 is shown. When a user applies a force to pushbar 72, the pushbar and collar 60 are caused to pivot about body portion 32 and, more specifically, the center point of the spherical zone of body portion 32. When pushbar 72 pivots, retainer 84 also swings causing movement of flexible tip 90 from a position substantially on center axis 41 to an angled position relative to center axis 41. When so pivoted, an aerosol product is dispensed from flexible tip 90 and may be received on a user's hand beneath pushbar 72. Release of pushbar 72 will allow the pushbar, retainer 84, and collar 60 to return to an unactuated position by virtue of the resiliency inherent in the flexible tip 90. Arms 82 and retainer 84 may collectively be referred to as a transfer mechanism because they transfer an input force applied to the pushbar to the flexible tip 90.

While FIG. 4 shows movement of pushbar 72 in the conventional direction, or in a direction perpendicular to the vertical surface to which dispenser 20 is mounted, it will be appreciated by those skilled in the art that an input force may be applied in a plurality of directions to actuate dispenser 20. Referring to FIG. 1, an input force may also be applied from right to left, or left to right, or from any position around sink 12, to cause actuation of dispenser 20.

Figure 6:
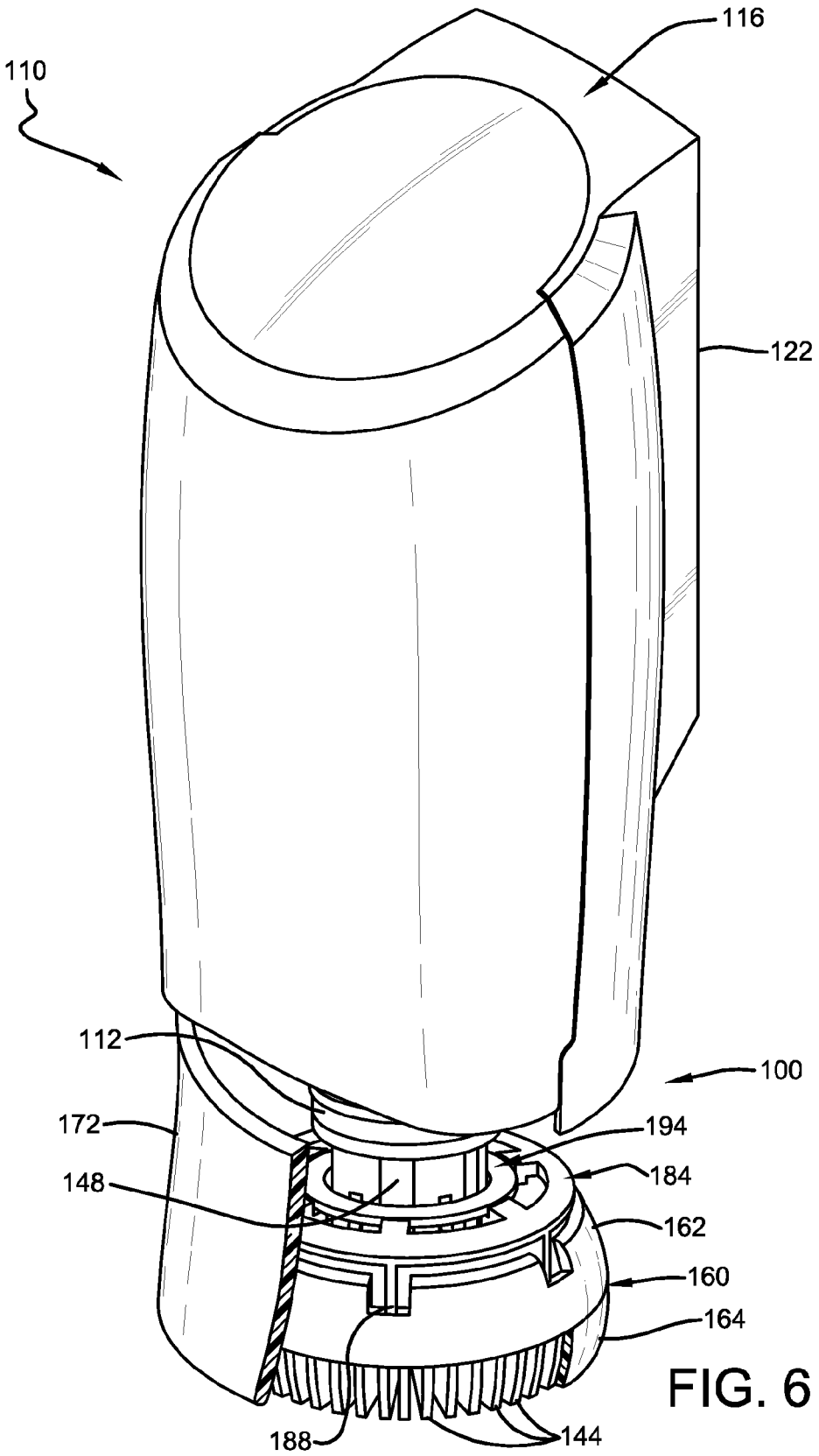
FIG. 6 is a partially cut-away perspective view of a refill unit and actuation mechanism including a multi-directional pushbar according to a second embodiment of the invention.
Figure 7:
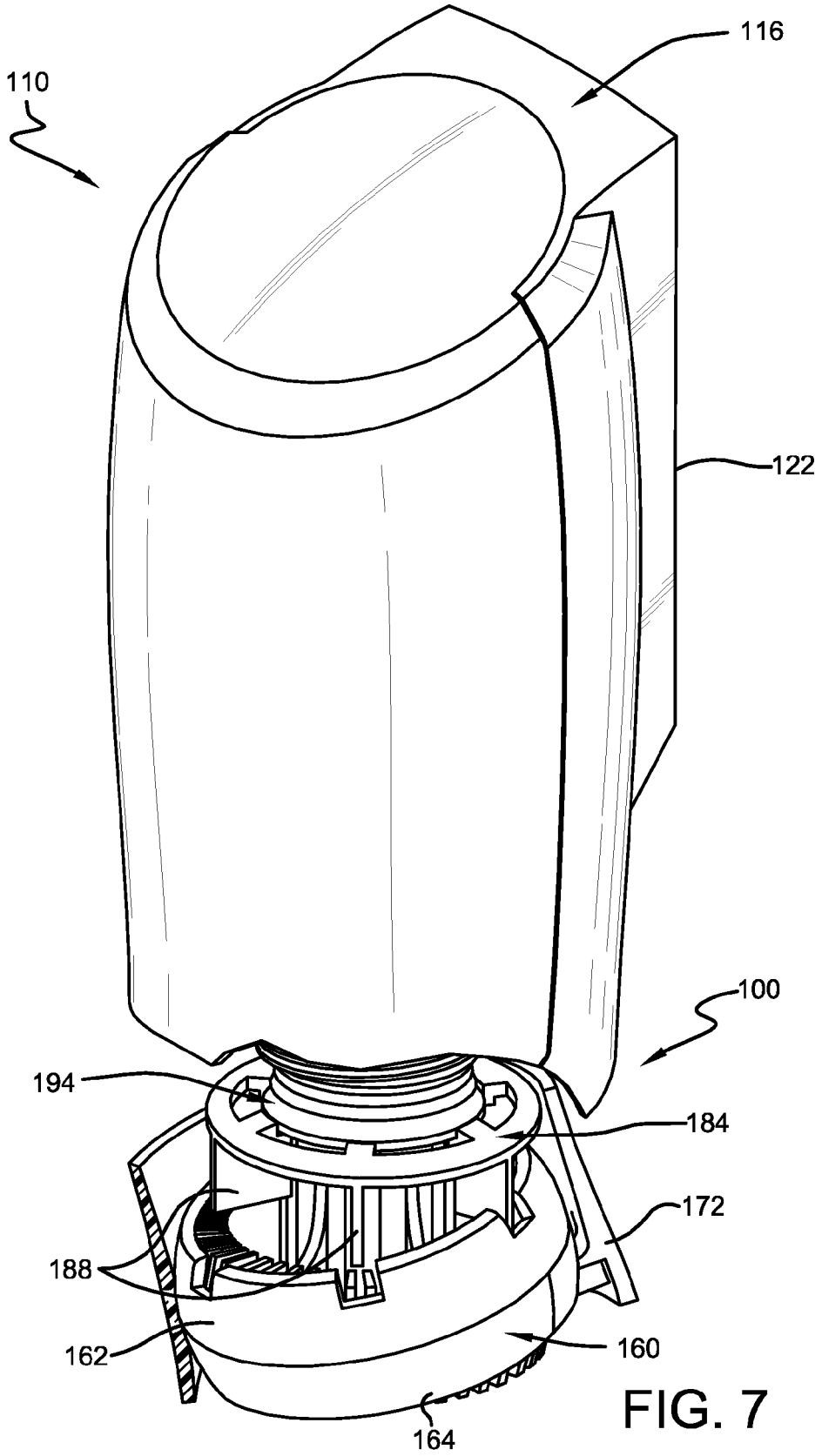
FIG. 7 is a partially cut-away perspective view of the refill unit and actuation mechanism of FIG. 6 where the pushbar is in an actuated position.
Figure 8:
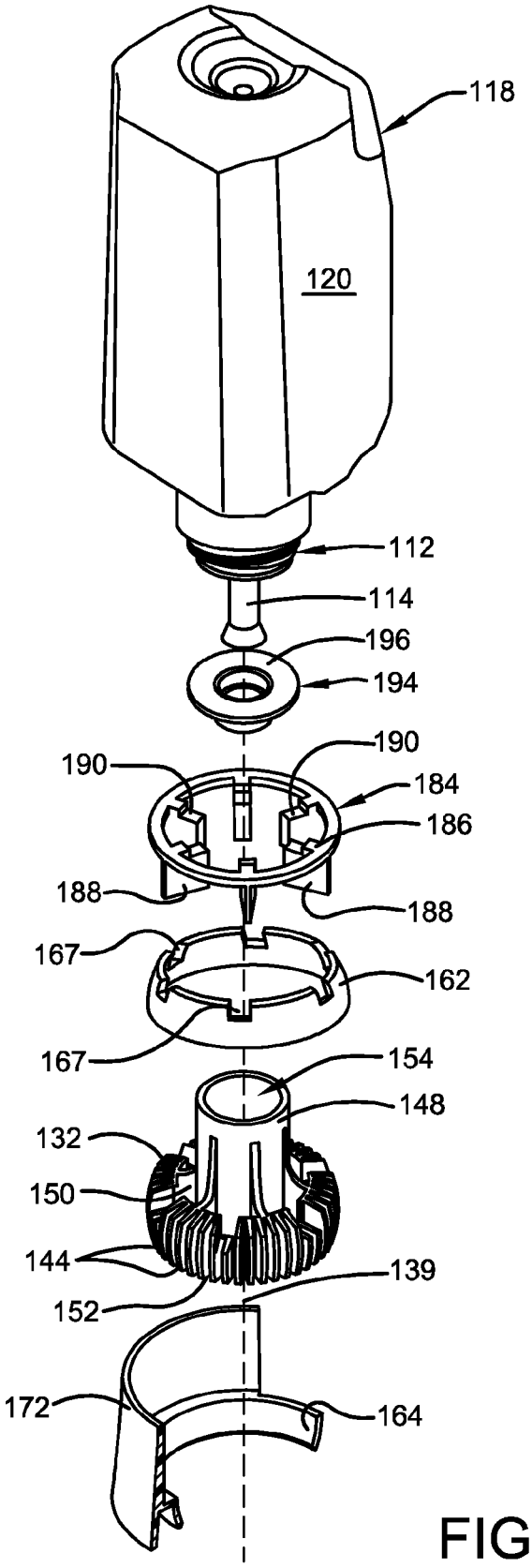
FIG. 8 is a perspective exploded view of the refill unit and actuation mechanism of FIG. 6.

Referring now to FIGS. 6-8, a second embodiment of a multi-directional pushbar and actuation mechanism according to the concepts of the present invention is shown and is indicated generally by the numeral 100. Actuation mechanism 100 is similar in many respects to the actuation mechanism of dispenser 10, as will be appreciated by those skilled in the art. Actuation mechanism 100 is adapted to be used in a dispenser 110 positioned in a location where use from a plurality of positions and angles is envisioned. For example, a dispenser 110 incorporating actuation mechanism 100 may be positioned in place of dispenser 10 shown in FIG. 1.

Actuation mechanism 100 is adapted to dispense a liquid or foam product utilizing a piston pump 112 (FIG. 8). As is known to those skilled in the art, reciprocating movement of the pump's piston 114, in this case in a vertical direction, causes dispensing of a product, and priming of the pump. As with dispenser 10, a housing 116 is provided to surround and support the components of the actuation mechanism and to hold the refill unit 118 (FIG. 8), which includes a product reservoir 120 and the pump 112. An end of the piston 114 engages the actuating mechanism 100 so that movement of a pushbar can actuate the pump, as discussed below.

A pushbar support member 130 is supported below refill unit 118 by housing 116. The mechanism for supporting the pushbar support member 130 below refill unit 118 is not shown in FIGS. 6-8, but it will be appreciated by those skilled in the art that the support arm 44 shown in FIGS. 1-5 may easily be adapted to support pushbar support member 130 and secure it to the housing 116 below refill unit 118. The pushbar support member 130 is adapted to support the components of the actuating mechanism and to receive and support the refill unit 118 therein. Pushbar support member 130 includes a radiused body portion 132. Body portion 132 is generally in the form of a spherical zone. A central axis 139 extends vertically through the center point of spherical body portion 132 about which the pushbar pivots, as will be discussed below. A plurality of radial fins 144 may extend outwardly from body portion 132.

Pushbar support member 130 also includes a guide post 148 positioned concentrically within body portion 132 and extending upwardly therefrom. Guide post 148 has a diameter less than the diameter of body portion 132, and is therefore spaced from the inner surface of body portion 132 by a gap 150. Radial ribs 152 are circumferentially spaced around guide post 148 and extend between the guide post 148 and the inner surface 136. A dispensing channel 154 is formed within the hollow guide post 148 to allow liquid or foam dispensed from piston pump 112 to exit the dispenser 110.

A collar 160 is positioned around body portion 132 of pushbar support member 130. Collar 160 is similar to collar 60 discussed above and includes a top collar portion 162 and a bottom collar portion 164 that, when secured together, form collar 160. Collar 160 is generally cylindrical in shape, but has a radius, or curve, from top to bottom so that it mirrors the shape of body portion 132. The curve or radius of collar 160 also helps to retain the collar on the pushbar support member 130 while allowing the cover to pivot around body portion 132. As will be appreciated by those skilled in the art, collar 160 is sized to fit over and around body portion 132 with a small space or gap therebetween to facilitate movement of collar 160 relative to body portion 132.

Top collar 162 further includes circumferentially spaced notches 167 at a top edge. Each recess 167 extends partially through top collar 162 toward bottom collar 164. Top collar 162 may also include a plurality of latch members (not shown) that extend downwardly and are received in slots in bottom collar 164 to secure top collar 162 to bottom collar 164 as discussed above with respect to the collar 60. The inclusion of top and bottom collars 162 and 164, as opposed to providing a one-piece collar, facilitates assembly of the actuation mechanism. The seam between top collar 162 and bottom collar 164 is positioned on a plane of orientation that, in an unactuated state, is generally horizontal.

A pushbar 172 is integrally formed with bottom collar 164 and acts as an input mechanism for a user to actuate dispenser 110. Pushbar 172 is generally cylindrical in shape with an opening 174 that, when assembled, is located at the rear of the dispenser 110. Pushbar 172 is shown in the drawings as being partially cut-away so as to better illustrate the shape and configuration thereof, but it should be appreciated that pushbar 172 has an exterior appearance substantially similar to pushbar 72 of FIGS. 1-5. Thus, pushbar 172 is secured to collar 160 so that the pushbar may be pivoted about body portion 132 of pushbar support member 130 in a plurality of directions. Alternatively, pushbar 172 could be separate from bottom collar 164 and secured thereto by any known fastening mechanism.

A carriage 184 is positioned around guide post 148 and is free to move vertically between an unactuated position where it rests on body portion 132 and an actuated position spaced from the body portion. Carriage 184 includes an annular portion 186 and a plurality of inwardly extending feet 188 connected to an underside of the annular portion. Feet 188 are circumferentially spaced beneath annular ring 186 so as to fit within gap 150 and between radial ribs 152. Feet 188 are also equal in number to and aligned with notches 167. Each foot 188 may include a step 190, thereby creating an annular recess within annular portion 186. As will be appreciated by those skilled in the art, pivoting of pushbar 172 and collar 160 causes linear vertical movement of carriage 184 on guide post 148.

A piston retainer 194 is positioned between carriage 184 and piston 114. Piston retainer 194 is generally cylindrical and includes an outwardly extending rim 196 at a top edge. Rim 196 is received in the annular recess of carriage 184 formed by steps 190 in feet 188. An end of piston 114 is received within the piston retainer 194 but is prevented from extending entirely therethrough so that vertical movement of the carriage 184 is transferred to the piston retainer 194 and the piston 114. In this way, pivoting of the pushbar 172 in any direction causes actuation of the pump 112. Piston 114 is biased in an unactuated position so that when pushbar 172 is released, piston 114 exerts a downward force on piston retainer 194 and carriage 184 to return pushbar 172 to its unactuated position. Carriage 184 and piston retainer 194 may be collectively referred to as a transfer mechanism because they transfer an input force applied at the pushbar to the piston 114.

Figure 9:
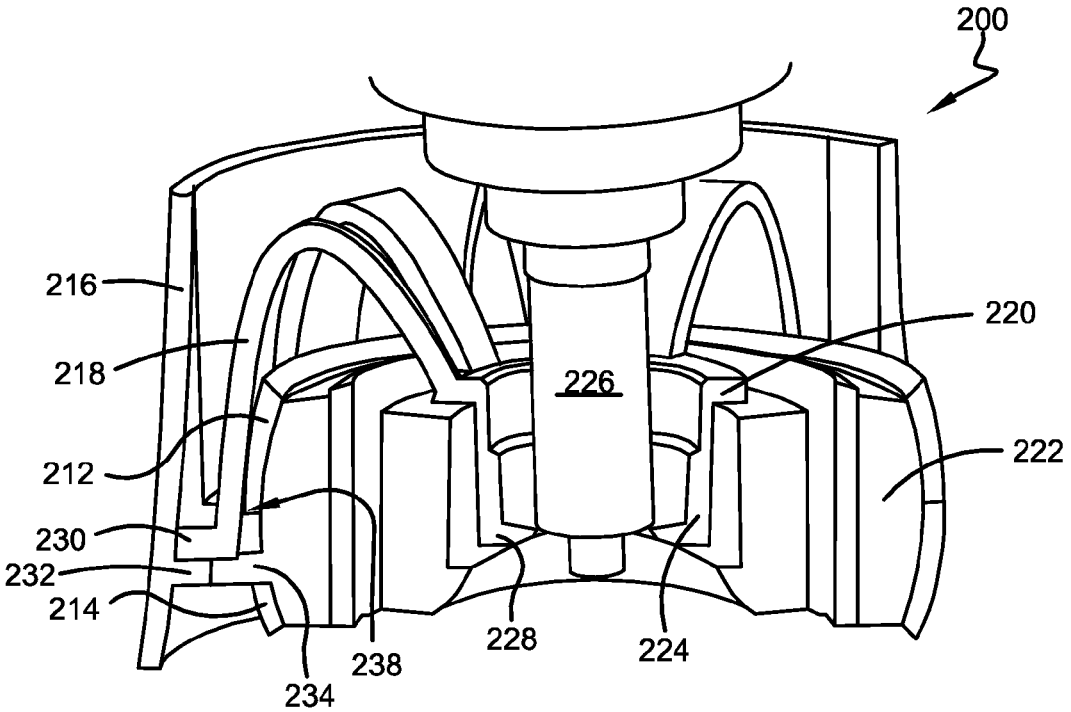
FIG. 9 is a fragmentary sectional view of a multidirectional actuation mechanism according to the concepts of a third embodiment of the invention.
Figure 10:
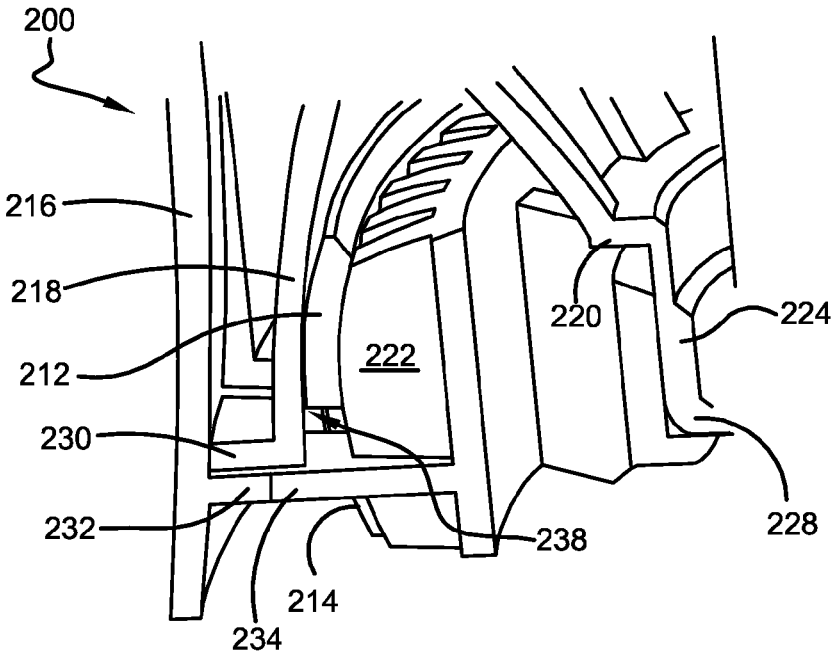
FIG. 10 is an enlarged fragmentary sectional view of the multidirectional actuation mechanism of FIG. 9.

Referring now to FIGS. 9 and 10, a third embodiment of a multi-directional pushbar and actuation mechanism according to the concepts of the present invention is shown and is indicated generally by the numeral 200. Actuation mechanism 200 is similar in most respects to the actuation mechanism 100 of the second embodiment, discussed above. Accordingly, only the features of the actuation mechanism 200 that are different from the actuation mechanism 100 will be discussed.

Actuation mechanism 200 includes a top collar 212 secured to a bottom collar 214 that carries a pushbar 216. A plurality of flexible fingers 218 are secured at one end to an interior of pushbar 216 (or alternatively top collar 212) and at a second end to a central ring 220 positioned within a pushbar support member 222. The number and spacing of fingers 218 may vary, and may be altered to optimize the performance of the actuating mechanism depending upon other performance variables. The material used to form the fingers 218 may be any flexible and resilient material known to those skilled in the art. Unlike the pushbar support member of the second embodiment 100 of the invention, the pushbar support member 222 does not include a guide post.

A piston retainer 224 is carried by central ring 220 and acts to transfer vertical motion from the central ring 220 to a piston 226. Piston retainer 224 is generally cylindrical and includes an inwardly extending rim 228 at a bottom edge that engages piston 226. The flexible fingers 218 may include outwardly extending feet 230 adjacent pushbar 216. In an unactuated position, feet 230 rest on an interior rib 232 extending from pushbar 216 and on an outwardly extending arm 234 extending from support member 236. The arms 234 are circumferentially spaced to align with the flexible fingers 218, and notches 238 are provided in one or both of the top and bottom collars 212 and 214 so that the arms 234 do not impede pivoting movement of the pushbar 216 and the collars. When the pushbar 216 is pivoted to move upward adjacent one or more of the flexible fingers 218, the interior rib 232 of the pushbar 216 causes the foot 230 to also move upward. At the same time, the arms 234 aligned with diametrically opposed feet 230 prevent the feet from moving downward with the pushbar 216 as it pivots, thereby transferring the forces generated by movement of the pushbar to the central ring 220 and piston 226.

As will be appreciated by those skilled in the art, vertical movement of the central ring 220 causes vertical movement of the piston 226, and thereby actuates a pump to cause a product to be dispensed. The piston 226 is biased to return to the unactuated position, which also causes central ring 220 to return to an unactuated position. In this way pivoting movement of the pushbar is transferred to the pump piston to cause actuation of the pump. Flexible fingers 218 and piston retainer 224 may collectively be referred to as a transfer mechanism because they transfer an input force applied at the pushbar to the piston 226.

Figure 11:
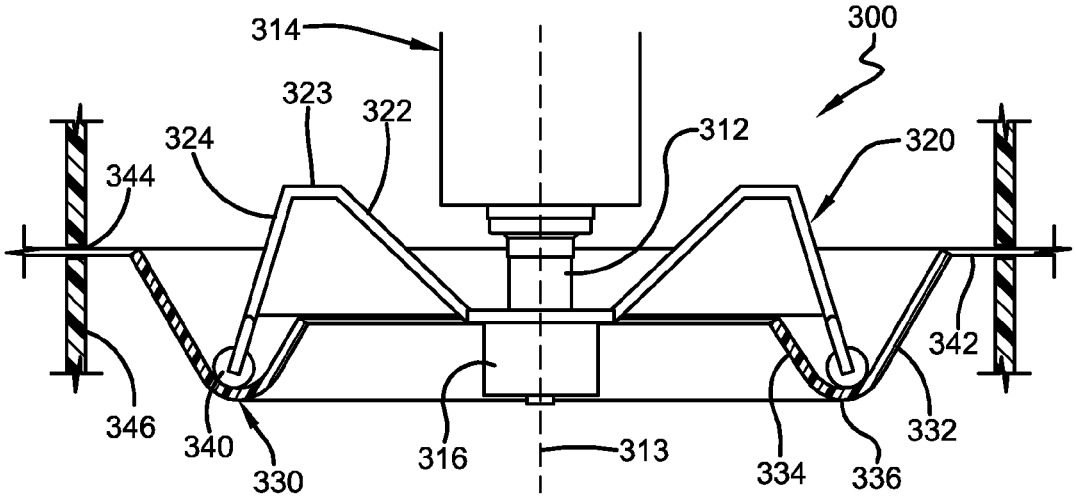
FIG. 11 is a sectional view of a multi-directional actuation mechanism in an unactuated position according to a fourth embodiment of the invention.
Figure 12:
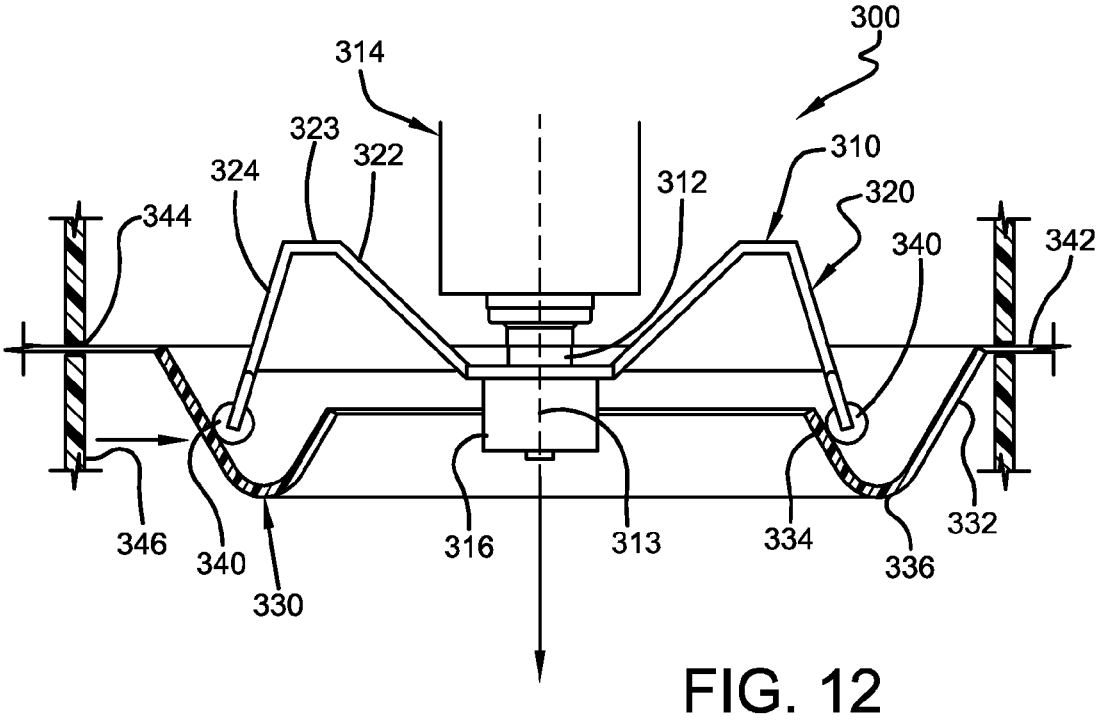
FIG. 12 is a sectional view of the multi-directional actuation mechanism of FIG. 11 in an actuated position.

Referring now to FIGS. 11 and 12, a fourth embodiment of a multi-directional pushbar and actuation mechanism according to the concepts of the present invention is shown and is indicated generally by the numeral 300. Actuation mechanism 300 includes a vertically movable carriage 310 that is engaged with a piston 312 of a piston pump 314, similar to the second embodiment of the invention discussed above. Thus, vertical movement of carriage 310 causes vertical reciprocation of piston 312 along a central axis 313, and dispensing of a product from pump 314. Piston 312 is biased in an unactuated position and therefore acts to return carriage 310 to an unactuated position. Carriage 310 includes a central retainer member 316 that receives an end of piston 312 therein. Retainer member 316 is hollow to allow product to be dispensed from piston 312, but may include an inwardly projecting rib or tabs to engage the end of piston 312. In an unactuated position retainer member 316 has a center point located approximately on the central axis 313.

Carriage 310 includes a plurality of outwardly extending arms 320 extending radially outwardly from retainer member 316. Any number of arms 320 may be provided, such as, for example, six arms spaced approximately 60 degrees from adjacent arms around retainer member 316. In certain embodiments, each arm 320 may include a first portion 322 angled upward, an intermediate portion 323, and a second portion 324 angled downward. This arrangement provides space below arms 320 to accommodate a pushbar 330, as will be apparent from the description to follow. Although a particular shape of arms 320 is shown and described, it is contemplated that alternative configurations of arms 320 may be used to provide the same space to accommodate the pushbar 330.

The pushbar 330 includes an outer portion 332 and an inner portion 334 angled relative to the outer portion, and an arcuate valley portion 336 connecting the outer and inner portions 332, 334. The outer portion 332 extends upwardly from the valley portion 336 and outwardly away from retainer member 316, and the inner portion 334 extends upwardly from the valley portion 336 and inwardly toward the retainer member 316. Pushbar 330 is positioned generally concentrically around carriage 310 in an unactuated position with a center point positioned approximately on central axis 313. As can be seen from the drawings, the outer portion 332, inner portion 334, and valley portion 336 of pushbar 330 together create a ramped recess for receiving rolling elements 340 provided on an end of each arm 320. The rolling elements 340 are rotatable, and may be, for example, balls, cylinders, or other rotatable shapes supported on an axis of rotation and known to those skilled in the art.

Pushbar 330 may also include a plurality of support legs 342 extending outwardly from outer portion 332. Support legs 342 may be equal in number to arms 320, and circumferentially spaced about pushbar 330 in a similar manner. Alternatively, a single support leg may be provided that is generally annular in shape and extends around a substantial portion of outer portion 332. Support legs 342 are received in slots 344 in a housing 346. As will be understood by those skilled in the art, the support legs 342 act to support pushbar 330 against undesirable movement in the vertical or axial direction. However, the positioning of support legs 342 in slots 344 does not prevent lateral or radial movement of the pushbar.

In operation, a user presses the outer portion 332 of pushbar 330 to move it laterally in any direction. Regardless of the direction of the actuation force, pushbar 330 is allowed to move laterally by slots 344 so that the center point of the pushbar 330 is spaced from central axis 313. When the pushbar 330 moves laterally, rolling elements 340 travel up one of the outer portion 332 or inner portion 334. Movement of the rolling elements 340 up the ramped surfaces results in vertical movement of carriage 310, and similar vertical movement of piston 312 to actuate the pump 314. Carriage 310 may also be referred to as a transfer mechanism because it transfers an input force applied at the pushbar to the piston 312. When the pushbar 330 is released, the piston 312, carriage 310, and pushbar 310 return to their unactuated positions by virtue of the biasing force within the pump 314. In this way the dispenser can be actuated from a plurality of positions and with an input force applied in any direction.

It is thus evident that a dispenser constructed as described herein accomplishes the objects of the present invention and otherwise substantially improves the art. Only the best mode and preferred embodiments have been presented and described in detail, and the invention should not be limited by that description. For an appreciation of the scope of the invention, reference should be made to the following claims.

The invention claimed is:

1. A product dispenser comprising:

a. a housing adapted to selectively retain a replaceable product refill unit, the product refill unit comprising a product reservoir and a dispensing mechanism;

b. the housing providing a multidirectional pushbar adapted to be pivoted about a plurality of axes relative to the remainder of said housing such that said multidirectional pushbar can selectively be pushed in any of a plurality of directions to actuate the dispenser, wherein the multidirectional pushbar is secured to a collar that is pivotable on a pushbar support member carried by the housing, the pushbar support member having the shape of a spherical zone; and c. a transfer mechanism adapted to cause dispensing of a product upon movement of the multidirectional pushbar by converting the input force applied to the pushbar into an actuating force against the dispensing mechanism of the refill unit to dispense a product.

2. The product dispenser of claim 1, wherein the collar includes a top collar portion and a bottom collar portion that are secured together.

3. The product dispenser of claim 1, wherein the pushbar support member includes an arm extending upwardly therefrom, the arm connected to the housing.

4. The product dispenser of claim 1, wherein a plurality of radial fins are provided on an outer surface of the pushbar support member.

5. The product dispenser of claim 1, wherein the transfer mechanism includes a carriage positioned around a guide post extending upwardly from the pushbar support member, the carriage being axially movable along the guide post upon pivoting movement of the multidirectional pushbar, movement of the carriage adapted to cause movement of a piston to cause dispensing of the product.

6. The product dispenser of claim 5, wherein the guide post is supported by a plurality of circumferentially spaced ribs extending inwardly from an inner surface of the pushbar support member.

7. The product dispenser of claim 6, wherein the carriage includes a plurality of circumferentially spaced feet carried by a rim, the feet received between the spaced ribs when the carriage is unactuated.

8. The product dispenser of claim 7, wherein a retainer is carried by the carriage and adapted to receive an end of the piston therein, the retainer including an outwardly extending rim that engages said feet.

9. The product dispenser of claim 1, wherein the transfer mechanism includes a plurality of flexible fingers extending between the collar and a ring positioned over the pushbar support member, the flexible fingers adapted to deform upon movement of the pushbar to cause vertical displacement of the ring, movement of the ring causing movement of the piston to dispense a product.

10. The product dispenser of claim 9, where a retainer is carried by the ring and adapted to receive an end of the piston therein, the retainer including an outwardly extending rim that engages said ring.

11. A product dispenser comprising:

a housing adapted to retain a product refill unit having a product reservoir;

a multidirectional pushbar adapted to be movable in a plurality of directions to actuate the dispenser, the multidirectional pushbar secured to a collar that is pivotable on a pushbar support member carried by the housing, the pushbar support member having the shape of a spherical zone; and a transfer mechanism adapted to cause dispensing of a product upon movement of the multidirectional pushbar by converting the input force applied to the pushbar into an actuating force, wherein the transfer mechanism includes a plurality of arms extending from the pushbar, and a disc shaped retainer supported by the arms, the retainer adapted to receive a tip of an aerosol refill unit therein, where pivoting movement of the pushbar causes movement of the retainer and dispensing of an aerosol product.

12. The product dispenser of claim 11, wherein the pushbar is generally cylindrical with an opening on one side, and wherein the arms extend radially inward from an inner surface of the pushbar to the retainer.

13. A product dispenser comprising:

a. a housing including a backplate and a cover and adapted to selectively receive a replaceable refill unit, the product refill unit comprising a product reservoir and a dispensing mechanism;

b. a pushbar support member carried by the backplate of the housing, the pushbar support member having the shape of a spherical zone;

c. the housing providing a multidirectional pushbar pivotable about the pushbar support member about a plurality of axes relative to the remainder of the housing such that said multidirectional pushbar can selectively be pushed in any of a plurality of directions to actuate the dispenser; and d. a transfer mechanism adapted to cause dispensing of a product upon movement of the multidirectional pushbar by converting the input force applied to the pushbar into an actuating force against the dispensing mechanism of the refill unit.

14. The product dispenser of claim 13, further comprising an arm connecting the pushbar support member and the backplate of the housing, the pushbar support member being spaced downwardly from the backplate.

15. The product dispenser of claim 13, further comprising a plurality of radial fins on an outer surface of said pushbar support member.

16. The product dispenser of claim 13, wherein the housing is a wall mounted housing.

17. A product dispenser comprising:

a housing including a backplate and a cover and adapted to selectively receive a replaceable refill unit, the product refill unit comprising a product reservoir and a dispensing mechanism;

a pushbar support member provided by the backplate of the housing, the pushbar support member having the shape of a spherical zone;

the housing providing a multidirectional pushbar pivotable about the pushbar support member in a plurality of directions relative to the remainder of the housing;

a transfer mechanism adapted to cause dispensing of a product upon movement of the multidirectional pushbar by converting the input force applied to the pushbar into an actuating force against the dispensing mechanism of the refill unit; and a collar positioned around the pushbar support member, the multidirectional pushbar being carried by the collar.

18. The product dispenser of claim 17, where said collar is radiused in the transverse direction to prevent axial removal from the pushbar support member.

19. The product dispenser of claim 17, wherein the collar includes a top collar portion and a bottom collar portion, the top and bottom collar portions being secured together.

20. The product dispenser of claim 17, wherein the housing is a wall mounted housing.

21. A product dispenser comprising:

a. a housing adapted to selectively retain a replaceable product refill unit, the product refill unit comprising a product reservoir and a dispensing mechanism;

b. a multidirectional pushbar adapted to be pivoted in a plurality of directions to actuate the dispenser from multiple angles; and c. a transfer mechanism adapted to cause dispensing of a product upon movement of the multidirectional pushbar by converting the input force applied to the pushbar into an actuating force against the dispensing mechanism of the refill unit, wherein the multidirectional pushbar is secured to a collar that is pivotable on a pushbar support member carried by the housing, the pushbar support member having the shape of a spherical zone, wherein the collar and the pushbar support member together form a ball and socket joint, having a ball received in a socket, the collar serving as the socket of the ball and socket joint and the pushbar providing the ball of the ball and socket joint.

* * * * *